United States Patent [19]

Evans

[11] Patent Number: 4,844,183

[45] Date of Patent: Jul. 4, 1989

[54] ACCELERATOR FOR FISHING JAR WITH HYDROSTATIC ASSIST

[75] Inventor: Robert W. Evans, Conroe, Tex.

[73] Assignee: Dailey Petroleum Services, Corp., Conroe, Tex.

[21] Appl. No.: 114,560

[22] Filed: Oct. 28, 1987

[51] Int. Cl.[4] ..... E21B 31/113

[52] U.S. Cl. ..... 175/296; 175/299; 175/321

[58] Field of Search ..... 175/298, 296, 300, 299, 175/321; 166/178

[56] References Cited

U.S. PATENT DOCUMENTS

| | | | |
|---|---|---|---|
| 2,265,431 | 12/1941 | Kerr | 255/27 |
| 2,721,056 | 10/1955 | Storm | 255/27 |
| 2,953,352 | 9/1960 | Webb | 255/28 |
| 3,472,326 | 10/1969 | Sutliff et al. | 175/321 X |
| 3,570,612 | 3/1971 | Slator | 175/297 |
| 3,606,297 | 9/1971 | Webb | 267/125 |
| 3,735,828 | 5/1973 | Berryman | 175/299 |
| 3,815,693 | 6/1974 | Sutliff et al. | 175/232 |
| 3,834,472 | 9/1974 | Perkins | 175/296 X |
| 4,179,002 | 12/1979 | Young | 175/297 |
| 4,196,782 | 4/1980 | Blamton | 175/297 |
| 4,200,158 | 4/1980 | Perkins | 175/297 |
| 4,545,444 | 10/1985 | Webb et al. | 175/296 |

FOREIGN PATENT DOCUMENTS 2033453 5/1980 United Kingdom .

*Primary Examiner*—Hoang C. Dang
*Attorney, Agent, or Firm*—Arnold, White & Durkee

[57] ABSTRACT

An accelerator for a fishing jar is disclosed. The accelerator includes front, compression, rear, and air chambers. These chambers insure that the pressure of the fluid in the compression chamber is substantially independent of the temperature of the fluid and the hydrostatic pressure of the well. These chambers also insure that the high pressure seals of the compression chamber are lubricated on each side of each seal. The accelerator also insures that a threshold upward force which is proportional to the hydrostatic pressure must be applied to the drill string before the fluid in the compression chamber begins to be compressed, thereby providing an accelerator that has a higher maximum load in deep wells.

6 Claims, 3 Drawing Sheets

1
2
100
3
50
34
4
6
7

8
9
33
11
12B
12
12A
13
14

ACCELERATOR FOR FISHING JAR WITH HYDROSTATIC ASSIST

BACKGROUND OF THE INVENTION

The present invention relates to accelerators for fishing jars. The invention has particular application in accelerators which use a compressible fluid to accelerate the jarring action.

Conventional accelerators for fishing jars generally include a mandrel, that is telescopically arranged with an outer housing, and a fluid filled chamber, which is positioned between the mandrel and the housing. In these accelerators, the volume of the fluid chamber decreases as the mandrel telescopes out of the outer housing. This chamber is filled with a compressible fluid that enables the acceleration of the jarring action when the compressed fluid expands after the jar has tripped. In the simplest of these accelerators, the compression chamber, that is filled with a compressible fluid, is sealed by upper and lower seals. These seals are located between the mandrel and housing and prevent fluid from flowing out of or into the fluid chamber.

In such an accelerator, the upper and lower seals may be lubricated on the sides exposed to the fluid within the fluid chamber. Their other sides, however, may be exposed to the mandrel's and housing's abrasive nonlubricated surfaces that lie outside of the fluid chamber. For example, the section of the accelerator on the upward side of the upper seal may be exposed to drilling mud, rather than a fluid having better lubricating properties. After the jar has tripped, and the mandrel begins to slide downward within the accelerator housing, this upper seal rubs against the section of mandrel that is lubricated only with the drilling mud, causing the upper seal to come into contact with a relatively abrasive surface while still energized by the high pressure compressed fluid.

Similarly, the downward movement of the mandrel causes the lower seal to come into contact with a lower section of the mandrel which, like the upper section, is not as well lubricated as the surface of the mandrel that borders the compression chamber. This downward movement thus also causes the lower seal to contact a relatively abrasive surface. To prevent excess wear and to lengthen the useful lives of such working parts as these seals, it is desirable that they be lubricated on each side so that the seals that are subjected to high pressure differentials will remain properly lubricated whether the mandrel is moving upward or downward.

In these same conventional accelerators, the compressible fluid used to achieve the desired spring effect and at the same time maintain an economical tool length is usually a silicone oil. Silicone oil, in general, has a low bulk modulus compared to other hydraulic fluids or lubricating oils. By way of example, the bulk modulus of silicone oil is about 150,000 p.s.i., compared to about 265,000 p.s.i. for mineral based hydraulic fluids. However, the bulk modulus of silicone oil is significantly increased if the pressure of the oil is increased, as will occur when the tool is subjected to the hydrostatic pressure of an oil well. If the bulk modulus of the silicone oil is allowed to increase, the accelerator will become ineffective because it will lose much of its stroke.

Conventional accelerators attempt to overcome this weakness by isolating the silicone fluid from the hydrostatic pressure by confining the fluid in a closed chamber. This is only partially effective because the temperature of the well bore will, in general, increase in proportion to the hydrostatic pressure. If the temperature of the oil in a closed chamber is increased the pressure of the oil will increase in proportion if the oil is not allowed to expand. An advantage of the present invention is that it may provide an accelerator that effectively isolates the silicone oil from the hydrostatic pressure of the well bore and at the same time may provide an expansion chamber that prevents the increase in well bore temperature from increasing the pressure of the silicone oil, thereby providing an accelerator with an effective stroke under any expected combination of hydrostatic pressure and well bore temperature.

The effectiveness of the jarring action is related to the sum of the total stretch of the pipe above the jar plus the stroke of the accelerator. If the well is shallow or the fishing string is short there will be minimal pipe stretch, and under these conditions it is desirable that the accelerator begin to stretch open at a low pull. However, if the well is deep and the fishing string is long there will be significantly greater pipe stretch, and under these conditions it is desirable that the accelerator be able to resist a higher load before reaching the end of its stroke. It is a further advantage of the present invention that it may provide an accelerator that automatically varies its operating range in response to changes in hydrostatic pressure, thereby achieving an accelerator that is effective both shallow and deep without being excessively long.

SUMMARY OF THE INVENTION

The present invention provides an accelerator for a fishing jar which comprises:

(1) an outer housing;
(2) a mandrel telescopically arranged with the outer housing;
(3) a compression chamber positioned between the mandrel and the outer housing for containing a compressible fluid;
(4) means for compressing such a compressible fluid in response to movement of the mandrel;
(5) sealing means for sealing the compression chamber;
(6) a chamber disposed adjacent to the sealing means for isolating the sealing means and any compressible fluid from the well fluid pressure; and
(7) means for engaging the accelerator to a drill string.

In a preferred embodiment the means for compressing the fluid is a piston that is positioned between the mandrel and the outer housing together with an upset that is engaged to the mandrel and positioned adjacent to the piston. In this embodiment, movement of the mandrel forces the upset against the piston which in turn forces the piston to compress the fluid.

A preferred sealing means includes upper and lower compression chamber seals. The chamber for isolating the sealing means and compressible fluid from the well fluid pressure preferably is a rear chamber that is positioned between the mandrel and the outer housing and is positioned adjacent to the compression chamber. This rear chamber may conveniently receive fluid from the compression chamber as the fluid expands in response to an increase in temperature. A floating piston, having upper and lower sides and that is positioned between the outer housing and the mandrel, may be placed within the rear chamber. The floating piston may slide to allow fluid flowing from the compression chamber to expand into the rear chamber.

In addition to the rear chamber and floating piston, this preferred embodiment preferably includes a means for permitting passage of the fluid from the compression chamber into the rear chamber. This means for allowing passage of the fluid would permit passage of the fluid only when the fluid was not being compressed. When the fluid was being compressed, fluid would not be allowed to pass from the compression chamber to the rear chamber.

This rear chamber in this embodiment includes an air chamber positioned adjacent to the floating piston. This air chamber receives the floating piston as it slides. A rear seal is positioned adjacent to the air chamber to form the lower boundary for the rear chamber. This rear seal has upper and lower sides and insures that the pressure exerted on the lower side of the floating piston is the pressure exerted by the air in the air chamber, rather than the hydrostatic pressure of any fluid on the lower side of the rear seal.

In this embodiment, the lower compression chamber seal is conveniently positioned between the compression chamber and the rear chamber. This seal insures that there is a pressure differential between the rear chamber and the compression chamber, when fluid in the compression chamber is being compressed.

Alternatively, the chamber for isolating the sealing means and compressible fluid from the well fluid pressure may be a front chamber positioned adjacent to the compression chamber and between the outer housing and the mandrel. This front chamber may receive and transmit fluid to and from the compression chamber or may be sealed off from the compression chamber. Either embodiment includes a front seal positioned adjacent to the front chamber. In the embodiment permitting communication between the fluid in the front chamber and the fluid in the compression chamber, the front chamber insures that, when fluid is not being compressed, the pressure of the fluid in the front chamber will be essentially the same as the pressure of the fluid in the compression chamber. This embodiment also includes means for permitting fluid to be transmitted between the front chamber and the compression chamber.

In a preferred embodiment, the accelerator of the present invention uses a valve to facilitate fluid transfer between the front chamber and the compression chamber. The valve permits fluid to move from the compression chamber to the front chamber when fluid is not being compressed. It prevents this fluid movement when the fluid is being compressed.

In this embodiment, the upper compression chamber seal is conveniently positioned between the front chamber and the compression chamber. This upper seal insures that there is a pressure differential between the front chamber and the compression chamber, when fluid is being compressed.

In a most preferred embodiment, the accelerator includes both front and rear chambers. In this most preferred embodiment, the rear chamber may include a floating piston that may or may not contact well bore fluid directly, i.e., this embodiment may or may not include the rear seal. Preferably, however, this embodiment also includes the rear seal. In this most preferred embodiment, the diameter of the front seal is preferably greater than the diameter of the rear seal.

As will become apparent from the detailed description of specific embodiments in use this most preferred embodiment includes an atmospheric chamber, i.e., a chamber kept at an approximately atmospheric pressure, that is bordered on either side by fluid having a pressure equal to the hydrostatic head. Because of this, this most preferred embodiment may accelerate the jarring action of the tool through both the expansion of fluid that has been compressed in the compression chamber and through a means for providing a differential pressure between the pressure of the atmospheric chamber and the hydrostatic pressure outside of the accelerator.

One advantage of the invention is that it may permit the mandrel's and outer housing's surfaces on either side of either of the high pressure compression chamber seals to be lubricated. This helps prevent contact between these moving seals and abrasive surfaces on the mandrel and housing (that could cause excessive wear on the seals and could shorten the seals' useful lives) irrespective of whether the mandrel is moving upward or downward.

Another advantage of the present invention is that it may permit the pressure of the fluid in the compression chamber to be substantially independent of increases in well bore temperature. In a preferred embodiment, the difference in pressure of the fluid in the fluid chamber as the accelerator is lowered to a deeper level in the well bore will not be dependent upon changes in the bulk modulus of the fluid. Rather, changes in this fluid's pressure will result from either changes in hydrostatic pressure, in an embodiment that does not include an air chamber on the downhole side of the floating piston, or from changes in pressure due to the compression of air present in the air chamber that is included in a preferred embodiment of the present invention.

A further advantage of the present invention is that it may require that a threshold force be exerted on the drill string before the means for compressing the fluid, such as a piston, begins to compress that fluid. This would insure that the force exerted against the walls of the compression chamber would be less than the force applied to the drill string to trip the jar by an amount equal to this threshold pressure. This reduced amount of force would help prevent blowout of the outer housing.

Additional advantages of the invention will be set forth in part in the description which follows and in part will be apparent from the description or may be learned by practice of the invention. The advantages of the invention may be realized and obtained by means of the instrumentalities and combinations particularly pointed out in the appended claims.

DETAILED DESCRIPTION OF SPECIFIC EMBODIMENTS

Figure 1A:
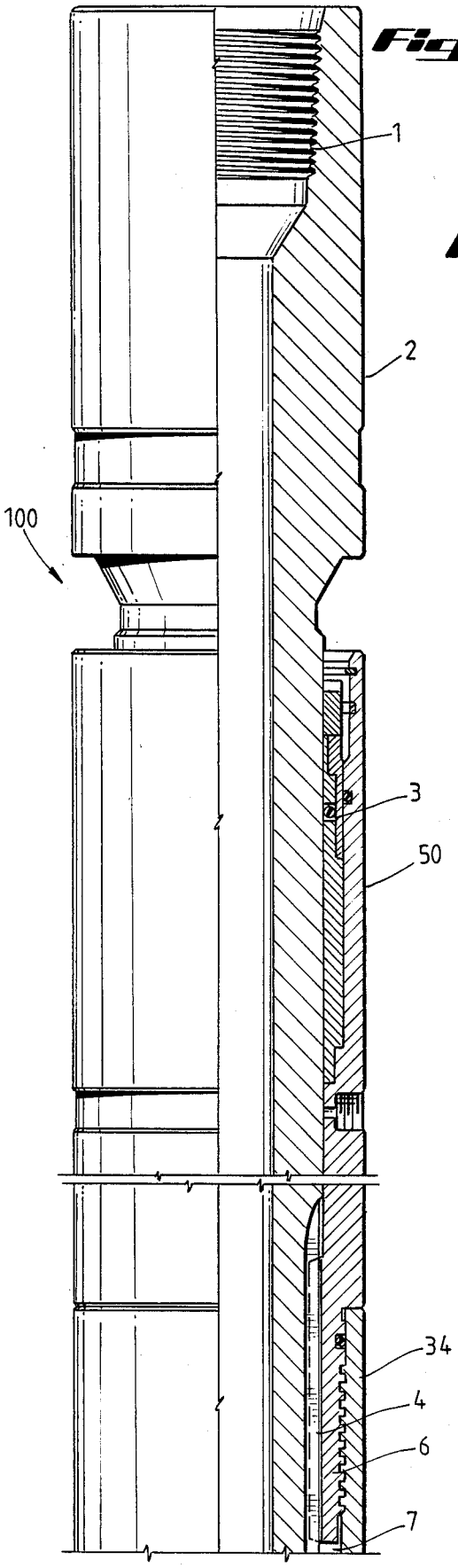
FIGS. 1A–1D is a partial cross sectional view of an embodiment of the accelerator of the present invention while in the contracted position.
Figure 1B:
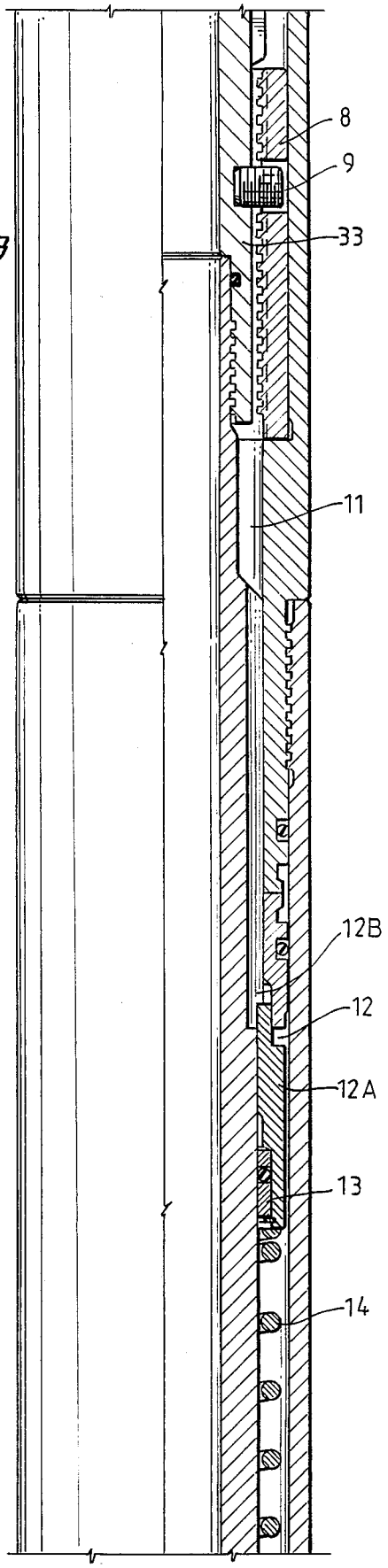
Figure 1C:
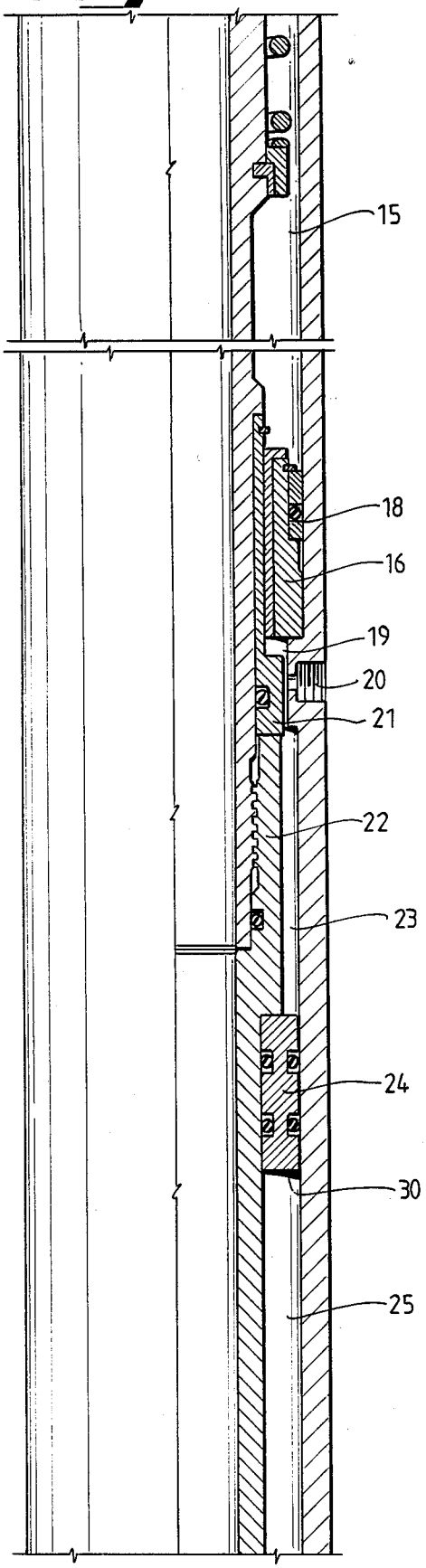
Figure 1D:
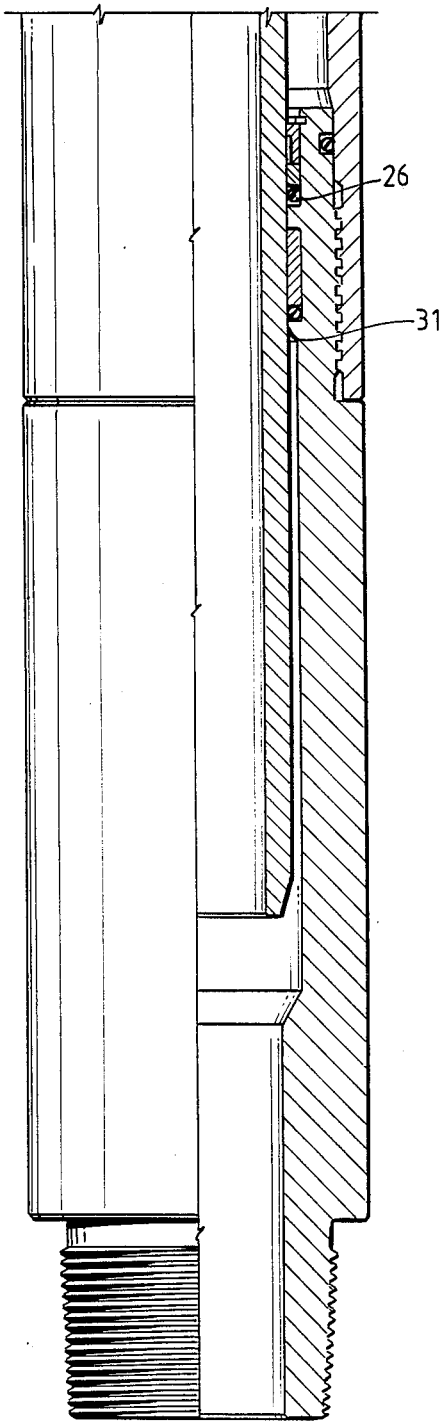

FIGS. 1A–1D shows a specific embodiment of the accelerator 100 of the present invention. In this embodiment, mandrel 2 is telescopically arranged with outer housing 50. Mandrel 2 engages the upper section of the drill string at threads 1. When the upper section of the drill string is pulled upward, mandrel 2 slides upward within housing 50. After the jar is tripped, housing 50 accelerates upward causing the drill string below the accelerator to travel upward faster than the drill string above the accelerator. Mandrel 2 is preferably a spline mandrel, as shown in FIG. 1. In this embodiment, mandrel 2 engages housing 50 at splines 4. Splines 4 permit axial movement between mandrel 2 and housing 50, while allowing torque to be transmitted between mandrel 2 and housing 50.

The accelerator includes a compression chamber 15. Chamber 15 is an annular space positioned between mandrel 2 and housing 50. Chamber 15 extends from upper compression chamber seal 13 to lower compression chamber seal 18. Chamber 15 accommodates a compressible fluid that may be fed into the accelerator at fill hole 20.

The accelerator shown in FIG. 1 includes a means for compressing such a fluid after the fluid is injected into chamber 15. The means for compression shown in this embodiment is a piston 16, an upset 21 and a projection 22. In operation, an upward movement of the drill string pulls mandrel 2 upward, causing projection 22 to force upset 21 against piston 16. Any further movement causes piston 16 to compress fluid that has been injected into chamber 15.

The accelerator shown in FIGS. 1A–1D also includes a sealing means for sealing the chamber 15, which in this embodiment is an upper compression chamber seal 13 and a lower compression chamber seal 18.

The accelerator shown in FIGS. 1A–1D also includes two chambers that are disposed adjacent to the sealing means for isolating the sealing means and the compressible fluid from the well fluid pressure. One of the chambers shown in this embodiment includes a rear chamber 23 that is positioned behind chamber 15, between mandrel 2 and outer housing 50. Rear chamber 23 extends from valve 19 to rear seal 26. This rear chamber 23 may receive fluid from chamber 15 as the fluid expands in response to temperature increases.

The floating piston 24, positioned between housing 50 and mandrel 2, is placed within rear chamber 23. This piston 24 enables fluid to flow from compression chamber 15 into rear chambers 23 with the only resistance upon this fluid flow being the pressure against the lower surface 30 of floating piston 24.

The means for permittng fluid to pass from compression chamber 15 to rear chamber 23 may include a series of grooves in piston 16. Such grooves could allow fluid to flow from chamber 15 through valve 19 into rear chamber 23. In operation, as mandrel 2 is pulled upward, upset 21 contacts piston 16 closing valve 19. This prevents fluid from flowing from chamber 15 into rear chamber 23, when piston 16 begins to compress the fluid.

The accelerator shown in FIGS. 1A–1D includes an air chamber 25. Air chamber 25 extends from the downhole side 30 of floating piston 24 to rear seal 26. Rear seal 26 forms the lower boundary for rear chamber 23. This air chamber 25 receives floating piston 24 as piston 24 slides along mandrel 2. Rear seal 26, that is positioned on the downhole side of air chamber 25, insures that the pressure exerted on the lower side 30 of floating piston 24 is the pressure exerted by the air in air chamber 25, rather than the hydrostatic pressure of any fluid on the downhole side 31 of seal 26. This insures that the pressure within rear chamber 23 and compression chamber 15 will be equal to the pressure of the air that is compressed in air chamber 25, which may be approximately equal to atmospheric pressure.

The second chamber that is disposed adjacent to the sealing means for isolating the sealing means and the compressible fluid from the well fluid pressure is front chamber 11 that is positioned in front of the compression chamber 15 and between outer housing 50 and mandrel 2. Front chamber 11 extends from front seal 3 down to upper compression chamber seal 13. In this embodiment front chamber 11 receives and transmits fluid from compression chamber 15 at atmosphere pressure. Valve 12 insures that this fluid flow occurs only when fluid is not being compressed in chamber 15.

When mandrel 2 is pulled upward, valve 12 closes, preventing fluid from passing between compression chamber 15 and front chamber 11. Spring 14 ensures that valve 12 closes and remains closed when fluid is being compressed. Alternatively, valve 12 could be replaced with a seal that prevents fluid from communicating between front chamber 11 and compression chamber 15 without departing from the spirit and scope of the invention.

In the embodiment shown in FIGS. 1A–1D, front seal 3 insures that the pressure of the fluid in front chamber 11 will be essentially the same as the pressure of the fluid in rear chamber 23 and compression chamber 15, when fluid is not being compressed, rather than being the hydrostatic pressure of the fluid located above seal 3. Seals 13, 18 insure that there is a pressure differential between the pressure in front chamber 11 and rear chamber 23 and the pressure in compression chamber 15 when fluid in compression chamber 15 is being compressed.

In the preferred embodiment shown in FIGS. 1A–1D, front seal 3 has a diameter that is greater than the diameter of rear seal 26. In such a preferred embodiment, a threshold force must be applied to the drill string before piston 16 begins to compress the fluid in compression chamber 15. This threshold force is dependent only on the change in pressure between the hydrostatic head and the atmospheric pressure inside the tool multiplied by the difference in the areas of seal 3 and seal 26.

The apparatus shown in FIGS. 1A–1D and described above includes conventional materials used in available accelerators. Similarly, the accelerator of the present invention may be used with any conventionally used compressible fluid and with any conventionally used jarring mechanism, such as any hydraulic or mechanical jar.

In operation, the accelerator is in the contracted position shown in FIGS. 1A–1D prior to the upward pulling action on the drill string required to effect the tripping of the jar. When it is desired to trip the jar, the drill string is pulled upward which, in turn, pulls mandrel 2 upward. As mandrel 2 is pulled upward projection 22 forces upset 21 against piston 16 thus closing the valve 19. At the same time upset 12B on mandrel 2 moves up and allows upper piston 12A to move up which allows valve 12 to close. Further upward movement of mandrel 2 causes piston 16 to compress fluid that has been trapped in chamber 15. Piston 16 travels upward through chamber 15 until the desired overpull, i.e., the force at which the jar is tripped, is achieved.

This upward movement of piston 16 essentially acts to increase the stretch in the drill string which results from the upward movement of the drill string. The overpull force, i.e., the force applied to stretch out the accelerator and to compress the fluid within compression chamber 15, acts to extend accelerator 100. After the jar is tripped, the accelerator snaps back to the position shown in FIGS. 1A–1D. As it snaps back, it causes an acceleration of the drill string below the accelerator in the upward direction, which accelerates the jarring action of the fishing jar.

Figure 2A:
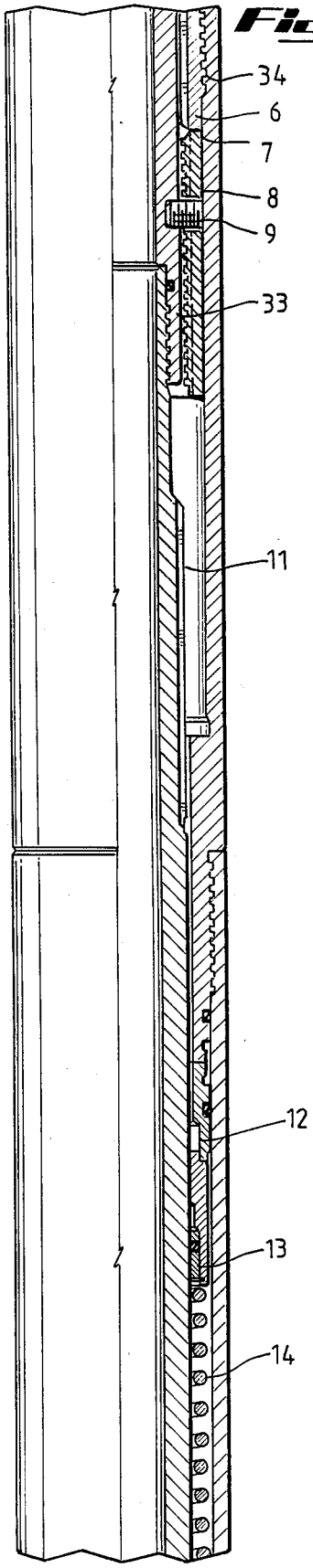
FIGS. 2A and 2B is a partial cross sectional view of the lower sections of the accelerator of FIGS. 1A–1D, shown in the fully expanded position.
Figure 2B:
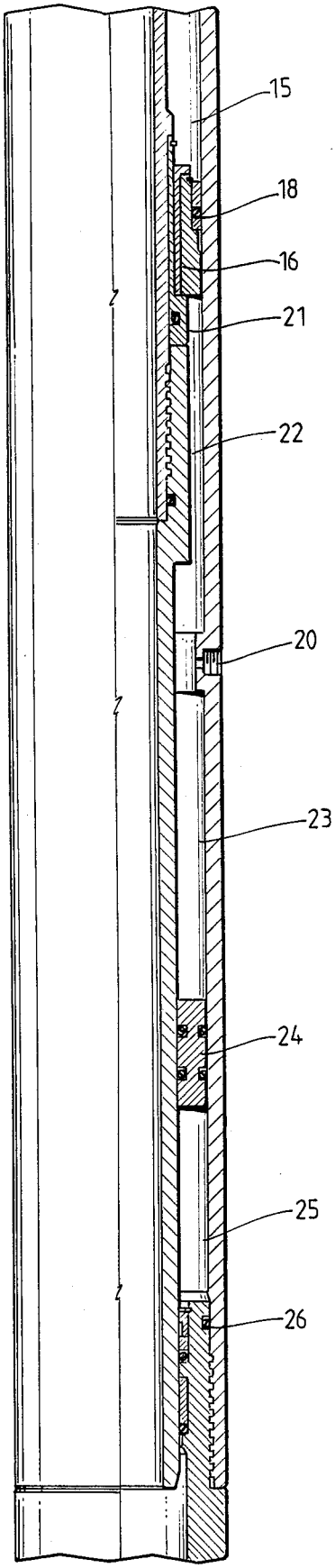

FIGS. 2A–2B shows the position of the lower sections of accelerator 100 at their maximum extension. In this position, hammer 8 (held by set screw 9 to threads 33 to prevent hammer 8 from unscrewing from mandrel 2) contacts shoulder 7 of pin 6, which is threaded into outer housing joint 34. Pin 6 thus prevents piston 16 from compressing fluid in compression chamber 15 to a pressure that may damage the seals or structural members of the accelerator. If the amount of travel of piston 16 was not otherwise restricted, a substantial pulling force on the drill string might cause piston 16 to force the fluid in compression chamber 15 to a pressure high enough to cause damage to the accelerator.

After the jar has tripped, and the drill string has been accelerated in an upward direction, accelerator 100 returns to its constracted position, as is shown in FIGS. 1A–1D.

It is apparent from FIGS. 1A–1D that rear chamber 23, which receives fluid flowing from compression chamber 15 when increases in temperature cause the fluid to expand, allows the accelerator piston 16 to travel essentially the same distance for a given upward force, regardless of the temperature of the fluid or the depth of the well bore at which the accelerator is located. This, in turn, ensures essentially the same expansion of the accelerator, irrespective of the depth in the well bore where the accelerator is positioned.

It should further be appreciated that the pressure in front chamber 11, compression chamber 15, rear chamber 23, and air chamber 25 will essentially be equal to the pressure in air chamber 25, which should approximately equal atmospheric pressure. Because of this, the hydrostatic pressure exerted against top seal 3 and the downhole side 31 of rear seal 26 also will help compress the accelerator after the jar has tripped. Thus, the jar's acceleration will result from both the force of the compressed fluid as it causes the accelerator to contract and the force of the hydrostatic fluid as it also forces the accelerator to contract after the drilling jar has been tripped.

In this regard it should be noted that the chamber lying between front seal 3 and rear seal 26 is essentially an atmospheric chamber. In use, these seals 3 and 26 provide a means for providing a differential pressure between the pressure of this atmospheric chamber and the hydrostatic pressure outside of the accelerator. This pressure differential helps accelerate the jarring action, when seals 3 and 26 are of different diameters.

Front chamber 11 and rear chamber 23 also insure that seals 13 and 18 will be lubricated regardless of whether mandrel 2 is moving upward or downward relative to outer housing 50. This helps insure that these high pressure seals will not come into contact with relatively abrasive surfaces that could cause more rapid wear.

It should also be appreciated that in the embodiment shown in FIGS. 1A–1D and 2A–B a threshold upward force must be applied before piston 16 may begin to compress fluid injected into chamber 15. This threshold force is the force required to pull mandrel 2 upward until valve 12 is closed and upset 21 contacts piston 16. This force is proportional to the difference between the hydrostatic pressure outside the tool and the atmospheric pressure inside the tool and the difference in the areas of seals 3 and 26.

This threshold force insures that the force exerted upon upper seal 13, lower seal 18, and outer housing 50 by the fluid being compressed in compression chamber 15 will be less than the amount of pull on the drill string by an amount equal to this threshold force. This decreased pressure within chamber 15 helps prevent the bursting of outer housing 50.

One advantage of the threshold force is that it increases the working range of the accelerator in deep holes. For example, at the surface the hammer 8 may bottom on pin 6 at a pull of 60,000 pounds. In contrast, if downhole in a particular well there is a threshold force of 15,000 pounds, then at this deep location in the well the hammer 8 would bottom on the pin 6 at 75,000 pounds, i.e., 60,000 pounds plus 15,000 pounds. This gives a larger working range for the same length tool.

The magnitude of the threshold force can be calculated from the mandrel diameters at seals 3 and 26 and the hydrostatic pressure (assuming that the pressure within the tool is approximately atmospheric). For example, if the diameter of seal 3 is 3.50 inches and the diameter of seal 26 is 2.75 inches, then the difference in area of the seals 3 and 26$=\pi/4(3.5^2=2.75^2)=3.682$ in$^2$. If the hydrostatic pressure is 5,000 psi, then the threshold force$=5000$ psi$\times 3.682$ in$^2=18{,}410$ lbs.

Additional advantages and modifications will readily occur to those skilled in the art. For example, it should be appreciated that although the accelerator of the present invention has been described to include both front chamber 11 and rear chamber 23, the accelerator of the present invention may include only the front chamber 11 or only the rear chamber 23. Further, although the accelerator described in the above embodiments is arranged such that the apparatus acts in response to an upward pull on the drill string, the apparatus could be rearranged to enable it to act in response to a downward force applied to the drill string in essentially the same manner in which it operates in response to an upward pull.

The invention in its broader aspects is therefore not limited to the specific details, representative apparatus, and the illustrative examples shown and described. Accordingly, departures may be made from the detail without departing from the spirit or scope of the disclosed general inventive concept.

What is claimed is:

1. An accelerator for a jar comprising:

an outer housing;

a mandrel telescopingly arranged with the outer housing;

first sealing means disposed between the mandrel and the outer housing for forming a compression chamber for containing a compressible fluid;

means disposed between the mandrel and the outer housing and within the compression chamber formed by the first sealing means for compressing such a compressible fluid in response to movement of the mandrel;

means for preventing such a compressible fluid from flowing from the compression chamber during compression of the compressible fluid;

second sealing means disposed between the mandrel and outer housing and longitudinally displaced from the first sealing means for forming a chamber which isolates the first sealing means and any compressible fluid from the well fluid pressure;

means for enabling any such compressible fluid to expand in response to an increase in temperature; and means in longitudinal and series displacement from the first sealing means and second sealing means for engaging the accelerator to a drill string;

the second sealing means which isolates the first sealing means and any compressible fluid from the well fluid pressure forming a rear chamber, positioned between the mandrel and the outer housing and adjacent to the compression chamber for receiving fluid from the compression chamber as the fluid expands in response to an increase in temperature, preventing fluid from the compression chamber from communicating with fluid lying outside of the accelerator, and wherein within the rear chamber is included:

a floating piston, having upper and lower sides, positioned between the outer housing and the mandrel and longitudinally arranged between the first sealing means and second sealing means, the floating piston slideable to allow fluid from the compression chamber to expand into the rear chamber; and the accelerator further including:

means for permitting passage of fluid from the compression chamber into the rear chamber, when fluid is not being compressed, and preventing fluid from passing from the compression chamber to the rear chamber, when any such fluid is being compressed.

2. The accelerator of claim 1 wherein the rear chamber further includes a chamber positioned between the floating piston and the second sealing means for receiving the floating piston as it slides.

3. An accelerator for a jar comprising:

an outer housing;

a mandrel telescopingly arranged with the outer housing;

upper and lower compression chamber seals disposed between the mandrel and the outer housing for forming a compression chamber for containing a compressible fluid, a piston positioned between the outer housing and the mandrel within the compression chamber formed by the upper and lower compression chamber seals; the piston including a means for passing fluid from one side of the piston to the other side of the piston;

means for preventing such a compressible fluid from flowing from the compression chamber during compression of the compressible fluid;

an upset engaged to the mandrel and positioned adjacent to the piston;

a rear seal having an inner diameter and an outer diameter, the inner diameter sealing against the mandrel and the outer diameter sealing against the outer housing, the rear seal longitudinally displaced from the lower compression chamber seal for forming a rear chamber positioned between the mandrel and the outer housing and adjacent to the compression chamber;

a floating piston positioned within the rear chamber longitudinally arranged between the lower compression chamber seal and the rear seal and positioned between the outer housing and the mandrel; and means disposed in longitudinal and series displacement from the lower compression chamber seal and the rear seal for engaging the accelerator to a drill string.

4. The accelerator of claim 3 further comprised of:

a chamber longitudinally arranged between the floating piston and the rear seal, and a front seal disposed between the mandrel and outer housing and longitudinally displaced from the upper compression seal, the upper and lower compression seals being longitudinally arranged between the front seal and the rear seal, for forming a front chamber positioned adjacent to the compression chamber and between the outer housing and the mandrel.

5. The accelerator of claim 4 further including a valve for permitting fluid to be transmitted between the front chamber and the compression chamber.

6. The accelerator of claim 4 wherein the mandrel has a first outer diameter and a second outer diameter and the first outer diameter is greater than the second outer diameter.

* * * * *